United States Patent [19]

Gongwer

[11] 4,455,962

[45] Jun. 26, 1984

[54] SPHERICAL UNDERWATER VEHICLE

[75] Inventor: Calvin A. Gongwer, Glendora, Calif.

[73] Assignee: The Bendix Corporation, Southfield, Mich.

[21] Appl. No.: 463,434

[22] Filed: Mar. 8, 1983

Related U.S. Application Data

[63] Continuation-in-part of Ser. No. 187,923, Sep. 17, 1980, Pat. No. 4,377,982, which is a continuation of Ser. No. 883,775, Mar. 6, 1978, abandoned.

[51] Int. Cl.[3] ..... B63G 8/08; B63G 8/16; B63G 8/24

[52] U.S. Cl. ..... 114/312; 114/56; 114/124; 114/147; 114/151; 114/330; 114/331; 114/338; 244/23 C; 244/51; 416/247 A; 440/71

[58] Field of Search ..... 440/71, 72; 416/247 R, 416/247 A; 244/51, 12.2, 23 C; 114/147, 148, 151, 124, 312, 330, 331, 332, 338, 56, 23; 405/185

[56] References Cited

U.S. PATENT DOCUMENTS

| | | | |
|---|---|---|---|
| 1,343,630 | 6/1920 | Locarni | 114/124 |
| 2,906,227 | 9/1959 | Smith | 114/23 |
| 3,096,739 | 7/1963 | Smith | 114/23 |
| 3,156,207 | 11/1964 | Giles | 114/23 |
| 4,034,696 | 7/1977 | Kureth | 114/151 |
| 4,377,982 | 3/1983 | Gongwer | 114/312 |

*Primary Examiner*—Sherman D. Basinger

*Attorney, Agent, or Firm*—Robert C. Smith; W. F. Thornton

[57] ABSTRACT

A spherical vehicle for operation in a fluid medium utilizes an actuator disk or propeller of approximately half the diameter of the sphere for propulsion. In addition to providing the energy for driving the sphere, the actuator disk acts to draw the flow of fluid smoothly over the after part of the sphere, thus avoiding or minimizing the tendency of the flow to separate from the surface of the sphere and create turbulence. For aircraft launch, a heavy shroud protects the actuator disk propeller and assures that the vehicle will sink rapidly after impact. The shroud is jettisoned at a desired depth. Steering in pitch and yaw planes is effected through the use of a plurality of powered thrusters located at or just behind the circle of maximum diameter (with respect to the direction of motion) and selectively actuated by a guidance or control system. Alternatively a single reversible thruster may be used for steering in yaw combined with a movable internal weight for pitch control. A plurality of stub vortex generators are also located on the aft side of the sphere and are angled or controlled to oppose the torque created by the propeller or to effect other guidance functions. For stability, the center of gravity preferably is located substantially below the geometric center of the sphere. The particular embodiment shown is an electrically (battery) powered underwater vehicle, but the same general configuration also applies to a manned submarine vehicle having the usual propulsion means.

6 Claims, 12 Drawing Figures

FIG. 2
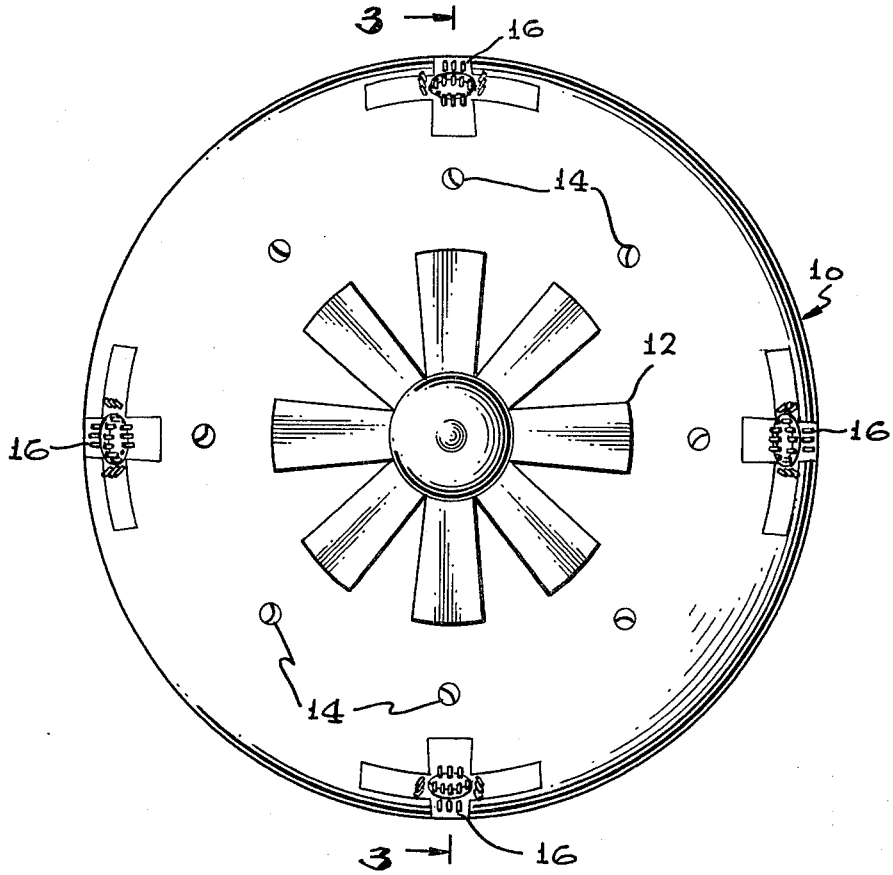
FIG. 1
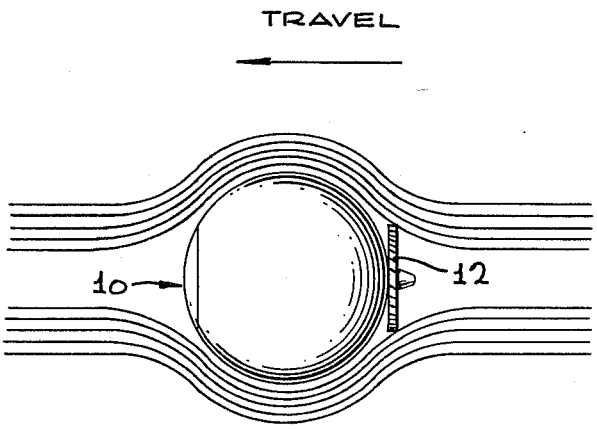
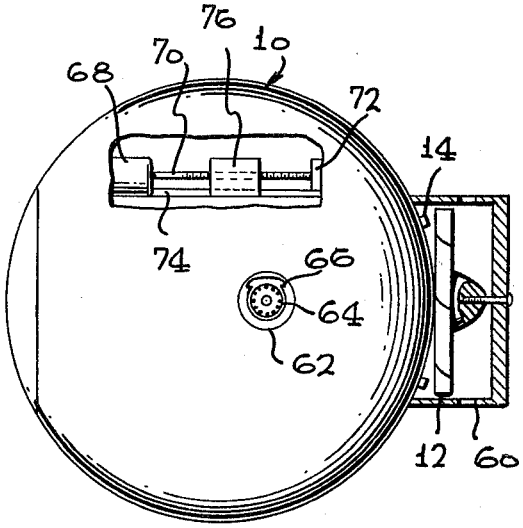
FIG. 5

FIG. 5A
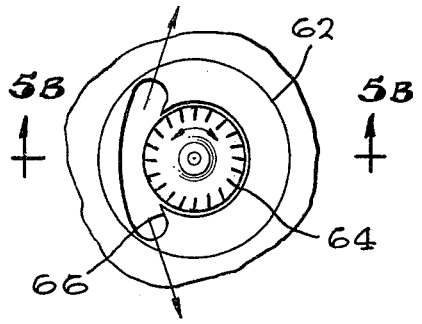
FIG. 5B
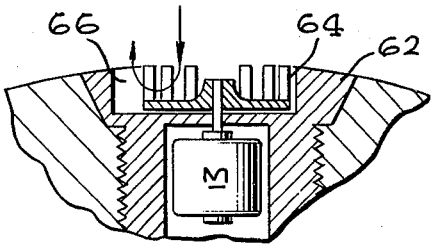
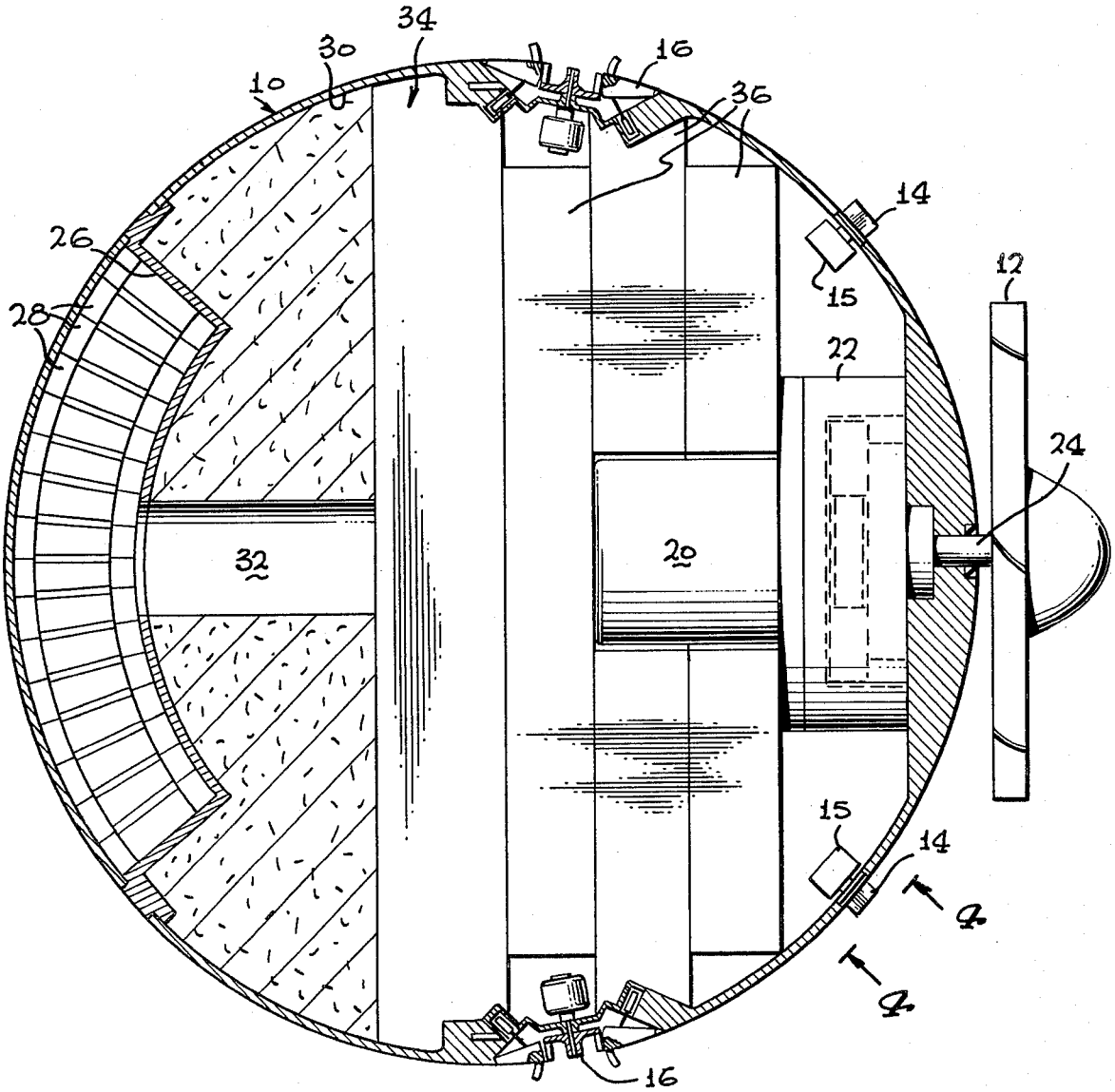
FIG. 3

SPHERICAL UNDERWATER VEHICLE

This is a continuation-in-part of application Ser. No. 187,923 filed Sept. 17, 1980 and now U.S. Pat. No. 4,377,982, which is a continuation of application Ser. No. 883,775 filed Mar. 6, 1978 and now abandoned.

The configuration of powered underwater vehicles has evolved through many years based on certain understood hydrodynamic and mechanical requirements. Aerodynamic considerations have resulted in somewhat similar shapes for lighter-than-air vehicles such as dirigibles and blimps. Where significant velocity through the fluid medium is required, the art seems to have settled on a generally tubular shape, rounded at the front and tapering toward the rear with the diameter made as small as the internal mechanism and/or flotation requirements will permit to minimize frontal area. This general configuration has been evident in the usual configuration of airships, of manned submarine vehicles, and of unmanned vehicles such as torpedoes. The power required to drive such a vehicle through the fluid medium varies with factors such as the effective frontal area, skin friction, and drag caused by separation of the flow over the surface of the body resulting in turbulence. A conventional way of avoiding flow separation over the rearward surfaces of such vehicles is to provide a tapering surface free of abrupt discontinuities with a propeller or impeller at or toward the rear.

Because of certain obvious advantages, some efforts have been made to fabricate and test experimental vehicles of spherical configuration. Such vehicles have inherently greater internal volume relative to their surface area than other shapes, and they have greater resistance to external pressure so can be lighter than conventional shapes because of less need for internal bracing or ribs. With greater diameter and less internal bracing required, a spherical vehicle could accommodate larger objects within than a tubular vehicle of comparable cubic content. Where a sonar must be incorporated, the larger diameter permits the use of a transducer array of much greater area than can be accommodated at the front of a tubular vehicle, so much better sonal performance could be realized.

Despite the above and possible other advantages of a spherical body for underwater vehicles, they have not been used in the past because testing has indicated that such bodies are inherently unstable. Generally spherical lighter-than-air vehicles have been used as balloons, but not as dirigibles or blimps, probably because the frontal area appeared excessive. When attempts were made in the past to move a spherical body through the water at any significant velocity, the boundary layer flow in the aft part of the sphere became separated at first one radial position and then another. This results in a low pressure at the separation region while high pressures act elsewhere, causing the sphere to be slowed toward the low pressure region. This displacement results in slowing of flow in said first region which causes the flow to again become attached there but to become detached elsewhere. The sphere will then move toward the new low pressure region. This phenomenon, applicable to both air and water vehicles, will continue causing the vehicle to tend to oscillate back and forth. Not only is the oscillation unacceptable, but the drag becomes prohibitive and so also does power consumption. At the present time, a further disadvantage is that all sorts of existing storage and mooring facilities, from hangars to harbor berths to torpedo tubes, are designed to accommodate the above described tubular shaped vehicles.

The problems to abrupt and erratic discontinuities in boundary layer flow discussed above can be dealt with if the spherical vehicle has an impellar or propeller of proper size and type at the rear which acts as a pump to pull the flow together around the sphere. If separation and turbulence does begin to occur, the pump (impeller) will promptly exhaust the dead air or water and reestablish the attached flow pattern. The impeller, which is of the actuator disk type, inducts part of the boundary layer and adds sufficient energy to restore its downstream velocity to just over the free stream velocity. This results in a nearly "wakeless" propulsion where the wake is left with no, or very little, absolute velocity. It is also known that the inducted water has had kinetic energy added to it by the drag process which lessens the shaft power required for a given thrust.

Steering is effected through the use of any of several control devices such as controlled vanes or reaction jets which are directed to provide control in yaw, pitch and, if necessary, in roll. Alternatively, control can be effected through the use of a plurality of thrusters such as those shown in my copending application Ser. No. 187,923, filed Sept. 17, 1980, which operate through an electrically-driven impeller wheel and a plurality of electrically, hydraulically or pneumatically operated shutters which are movable either to block all discharge from the impeller or to permit discharge from one side which creates a reaction force in the opposite direction to cause rotation of the vehicle in one of its operating planes. Another rather straightforward system which has proved successful has invloved a single reversible thruster located along the equator of the sphere for steering in yaw combined with a controlled weight or pendulum which is movable to shift the center of gravity of the vehicle to provide pitch control. Since the sphere has almost neutral stability, it is easily turned in yaw and pitch. In this way it is possible to eleminate some or all of various control surfaces, tail fins, etc., which add considerable drag whether actually in operation or not and which require some care in handling to avoid damage thereto. The size of such thrusters is, of course, variable with requirements depending upon the size of the spherical vehicle, the fluid medium, etc.

In some applications it may be necessary or desirable to include a plurality of stub wing vortex generators which assist in preventing separation of the flow and directing flow into the impeller or propeller and which also provide a means for compensating for torque of the impeller or propeller. Such stub wing vortex generators may also be controlled to provide roll stabilization or to effect other control functions.

In the drawings,

FIG. 1 is a diagrammatic plan view of a vehicle according to my invention shown in relation to the fluid medium in which it operates.

FIG. 2 is a plan view, from the rear, of a vehicle incorporating my invention.

FIG. 3 is a sectional view of the vehicle of FIG. 2, taken along line 3—3 of FIG. 2.

FIG. 5 is a side plan view, on a reduced scale and partly broken away, of an additional embodiment of my invention.

FIG. 5A is an enlarged plan view of he thruster shown in FIG. 5.

FIG. 5B is a sectional view taken on line 5B—5B of FIG. 5A.

Figure 6D:
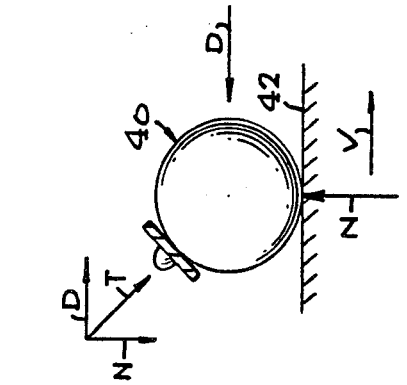
Figure 6C:
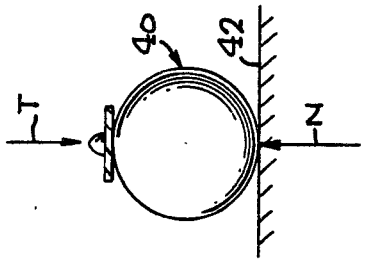
Figure 6B:
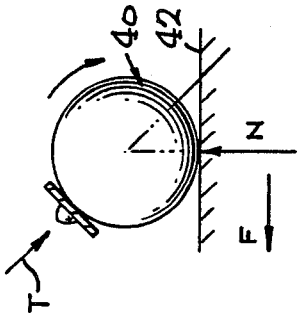
Figure 6A:
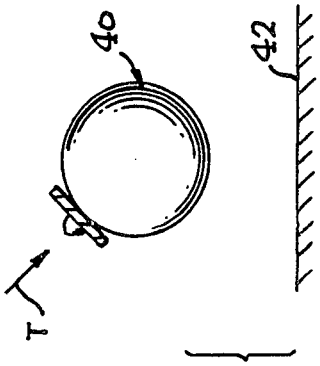
Figure 7:
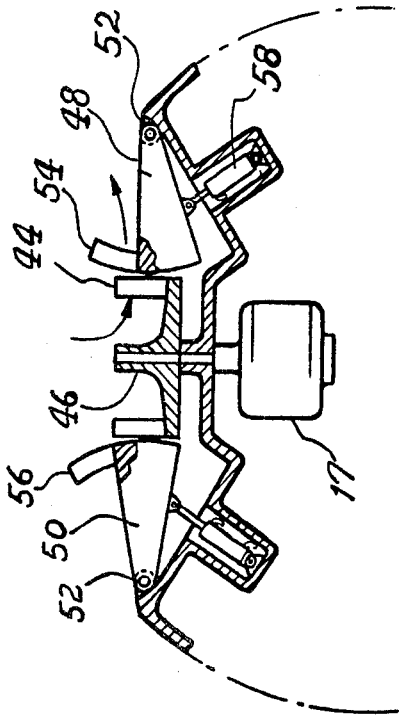

FIGS. 6*a* through 6*d* constitute a series of diagrams showing an operating characteristic of a vehicle made according to FIGS. 1 through 5. FIG. 7 is a side view, on an enlarged scale and partly in section, of one of the thrusters shown in FIG. 3.

Referring now to FIG. 1, a spherical vehicle 10 having an actuator disk impeller 12 at the rear is shown in conjunction with a flow pattern representing the fluid medium in which it is moving. This fluid medium may be gaseous (air) or liquid (water), and the flow pattern is similar. Where a sphere is moved at substantial velocity through a fluid medium, the flow pattern toward the rear typically becomes detached, breaking down into areas of low and high pressure and turbulence which cause the sphere to move in an unstable manner with a significant amount of sideways movement resulting in considerable drag. The actuator disk impeller 12 serves to pull the flow pattern toward itself, causing flow to remain smooth and attached to the wall of the sphere until it passes through the impeller. The impeller diameter will normally be approximately one-half the diameter of the sphere, and the usual clearance between the impeller tip and the spherical vehicle is about 7% of the sphere diameter.

In FIG. 2 a spherical vehicle is shown in plan view from the rear having a housing 10 and a rear mounted impeller 12. Forward of the impeller 12 are a series of small flow-directing tabs or stub vortex generators 14 which assist in preventing separation of the flow. They are also angled to provide a net torque counter to the impeller reaction which opposes the roll effect of the shaft torque. Still further forward and just aft of the circle of maximum diameter with respect to the direction of flow are a plurality of thrusters 16, discussed in greater detail below, which operate to create reaction forces under the control of the internal guidance and control system within the housing 10 for control in the yaw and pitch planes and possibly also in roll.

FIG. 3 is a sectional view taken along line 3—3 of FIG. 2. In this view the housing 10 is shown containing an electric motor 20 connected to a gearbox 22 having output shaft 24 connected to the hub of the impeller 12.

At the very front of the housing 10 is a recessed chamber 26 of large area which contains an array of sonar transducers 28, some for transmitting a sonar signal and some for receiving echoes of the transmitted signal. Immediately behind the chamber 26 is a space for payload 30 with a channel 32 therethrough for wiring, etc., connecting the sonar transducers 28 to a guidance and control system 34. Immediately behind the guidance and control system are a plurality of batteries 36 for providing propulsion to the impeller 12 as well as energy for the guidance and control system.

The thrusters 16 are controlled by a guidance system to direct flow as needed for steering. Typically there will be a pair of such thrusters and actuators for steering in yaw and another pair for pitch control. Since the vehicle should be constructed such that the center of gravity is substantially below the geometric center of the vehicle, roll control will not normally be a problem but could be dealt with by means of the thruster, if necessary, for any given construction. Obviously the stub vortex generators 14 provide some roll control, and some or all may be made adjustable or controllable in operation, as with motors 15 if desired. While a ring of such stub vortex generators is shown in FIG. 1, smaller numbers of such generators may be sufficient, and some or all of these may be either rotatable or selectively retractable for roll control. Those skilled in the art will recognize that there are a number of ways of implementing the control surfaces described above for control in the roll plane.

A side view of one of thrusters 16 is shown in FIG. 7. This thruster includes a plurality of blades 44 located on the periphery of a thruster rotor 4. Each of the blades is preferably angularly oriented with respect to a radius of the rotor 46. a plurality of shutter members 48, 50 are positioned around the periphery of the blades or rotor 44. Preferably there will be four such shutter members, each being pivotally mounted to rotate around pivots 52. In FIG. 7, the shutter member 48 has been pivoted around its pivot 52 such that its stator blades 54 are in registration with a portion of the rotor blade periphery, allowing for the exit of fluid through that portion of the rotor blades adjacent stator blades 54. The remainder of the stator blades, such as blade 56, are out of registry with the rotor blading, thus preventing the flow of fluid through the portion of the periphery of rotor 46 where the stator blades are so positioned. Thus, by operating shutter member 48, as by means of an electrical actuator 58 to permit flow through its stator blades 54, a reaction force is created opposite to the direction of the fluid flow past stator blades 54 in the direction of the arrow. This force will cause the spherical housing 10 to rotate opposite to the direction of the arrow. Preferably four such thrusters would be employed on applicant's spherical housing 10, located ninety degrees apart on or just aft of the circle of maximum diameter with respect to the direction of motion of the vehicle.

It will be apparent that the particular vehicle thus far described would have maximum utility as a torpedo, although a manned vehicle would be essentially the same with respect to control. The battery-type propulsion, of course, would normally be replaced with a type of prime mover typical of submarines such as diesel-electric systems, nuclear power plants, etc.

Figure 4:
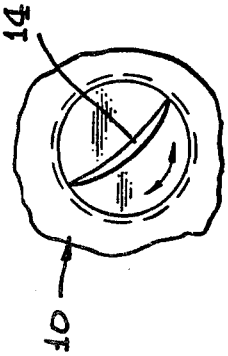
FIG. 4 is an enlarged view of a portion of FIG. 3 on line 4—4 of FIG. 3.

FIG. 4 is an enlarged view of a portion of FIG. 3 showing a single stub vortex generator 14. While the particular generator shown is indicated as a slightly cambered stub member which is manually oriented to the desired setting and then retained in position, as by a set screw, such members may be retractable or rotatable in operation by suitable rotary actuators driven from the guidance and control system 34. Synchros are one type of suitable rotary actuator for such stub vortex generators, and they may also be operated by suitable hydraulic rotary actuators.

FIG. 5 is a side view, on a reduced scale, of another embodiment of my invention. In this embodiment all the parts are essentially as described with respect to the embodiment of FIGS. 1 and 2 except that alternative positions of the stators or stub vortex generators 14 are shown closer to the impeller 12. Where it is desired to launch the vehicle from an aircraft or from a ship with an impact force which may be sufficient to damage the impeller, a protective shroud 60 may be fastened to the impeller hub. The shroud 60, in addition to protecting the impeller, also protects personnel handling the vehicle from the propeller blades and adds weight which causes the shroud to make first conact with the water and insures an adequate sink rate for the vehicle. Except for the shroud 60, vehicle 10 may be neutrally or even slightly positively buoyant. When the spherical vehicle reaches a desired depth, a pressure switch or timers may be employed to start the electric motor 10. Since the shroud 60 is fastened to the hub by means of a screw having reverse threads relative to the direction of rotation of impeller 12, the inertia of the shroud will cause the screw to rapidly back out of the hub and cause the shroud to be separated from the vehicle. The vehicle will then shift to an attitude in which the impeller is at the rear as shown in FIGS. 1, 2 and 3 and will then proceed toward a target as determined by its guidance and control system.

FIG. 5 also shows an alternative guidance system with a single modified thruster 62 which includes a reversible impeller 64. Depending upon the direction of rotation of the impeller 64, a reaction jet of water is directed in either a forward or aft direction through a channel 66 peripheral to the impeller to cause rotation of the vehicle in yaw. Located internally of the spherical housing 10 is a pitch control which includes a reversible electric motor 68 which turns a drive screw 70 supported at its opposite end in a bearing 72. Carried on the drive screw and supported on a low friction track 74 is a weight 76. Rotation of the motor 68 turns the drive screw 70 to cause the weight to move one way or the other, thereby shifting the center of gravity to one side or the other of the housing center and causing the housing to vary its attitude in the pitch plane.

The self-propelled spherical vehicle described herein has the characteristic that when moving toward or at a grazing angle with a solid surface, it tends to roll into a position where it is heading directly into, or normal to, the surface with the propeller turning at the rear. The thrust is through the center and has a moment around the contact point in a direction to place the thrust axis normal to the surface with which it is in contact. In FIG. *6a* a spherical vehicle 40 is shown approaching a solid surface 42 at an angle as indicated by the arrow T. FIG. *6b* shows the vehicle 40 at the point of making contact with the surface 42. The thrust T from the propeller or impeller is opposed at the point of contact by a first vector N normal to the surface and a second vector F parallel to the surface which is not opposed, resulting in rotation of the vehicle 40 in the direction of the arrow. This rotation continues until the vehicle reaches a position where the thrust force T is normal to the surface 42 as shown in FIG. 6, at which point there is no further horizontal force tending to cause rotation of the vehicle.

FIG. *6d* is a diagram similar to *6b* except that, in this view, the surface 42 is moving in the direction indicated by the arrow V. In this situation, a drag force is present, causing the vehicle 40 to retain an angled position relative to the thrust angle in a downstream direction.

I claim:

1. A self-propelled spherical vehicle for operation in a fluid medium comprising a generally spherical housing and an impeller external of said housing, an energy source and power means in said housing connected to cause rotation of said impeller, said impeller being at the rear of said vehicle with respect to its direction of motion, characterized in that said impeller is of the actuator disk type, is adjacent said housing and approximately half the diameter of said housing and spaced such that the distance of the propeller tips from the surface of the housing is approximately 7% of the diameter of said spherical housing such that it inducts a substantial part of the boundary layer at the rear of the vehicle to thereby reduce the drag on the vehicle caused by separation of the fluid over its surface, said housing and said impeller substantially defining the configuration of said vehicle, means carried by said housing for effecting steering thereof, including at least one fluid-deflecting device located aft of the circle of maximum diameter of said spherical housing with respect to its direction of motion, said devices being controllable to deflect a portion of the fluid adjacent the surface of said vehicle, and a generally cylindrical shroud fastened to said vehicle along to axis of said impeller, said shroud including a cylindrical member surrounding and spaced from said impeller, said shroud having significant weight such that, upon launching of said vehicle, it is caused to make initial contact with said fluid medium and causes said vehicle to sink to a desired depth in said medium after which said power means is energized and said shroud is jettisoned.

2. A self-propelled spherical vehicle for operation in a fluid medium comprising a generally spherical housing and an impeller external of said housing, an energy source and power means in said housing connected to cause rotation of said impeller, said impeller being at the rear of said vehicle with respect to its direction of motion, characterized in that said impeller is of the actuator disk type, is adjacent said housing and approximately half the diameter of said housing and spaced such that the maximum circle of rotation of said impeller is approximately 7% of the diameter of said spherical housing from the surface of said housing such that it inducts a substantial part of the boundary layer at the rear of the vehicle to thereby reduce the drag on the vehicle caused by separation of the fluid over its surface, said housing and said impeller substantially defining the configuration of said vehicle, and means carried by said housing to effect steering thereof, including a plurality of thrusters each of which includes a rotatable rotor carried substantially flush with the surface of said housing having a plurality of blades disposed around the periphery of said rotor and having an open inlet, a plurality of vanes adjacent the periphery of said rotor and actuator means for selectably actuating said vanes to produce a fluid discharge passage of limited area adjacent said rotor for directing exit flow to produce thrust in a desired direction, said thrusters being located aft of the circle of maximum diameter of said sphere with respect to its direction of motion.

3. A self-propelled vehicle as claimed in claim 1 wherein said shroud is threadedly engaged with said impeller such that turning of said impeller by said power means causes said shroud to separate from said impeller.

4. A self-propelled spherical vehicle for operation in a fluid medium comprising a spherical housing and an impeller external of said housing, an energy source and power means in said housing connected to cause rotation of said impeller, said impeller being at the rear of said vehicle with respect to its direction of motion, characterized in that said impeller is of the actuator disk type, is adjacent said housing and approximately half the diameter of said housing, and the distance of the impeller tips from the surface of the housing is approximately 7% of the diameter of said spherical housing such that the impeller inducts a substantial part of the boundary layer at the rear of the vehicle to thereby reduce the drag on the vehicle caused by separation of the fluid over its surface, said housing and said impeller substantially defining the configuration of said vehicle, said impeller including a hub of substantial diameter adjacent said spherical housing and tapering to the rear to assist in assuring attached flow over said housing, means carried by said housing to effect steering thereof including at least one rotatable thruster controllably directing a reaction jet of said fluid located aft of the circle of maximum diameter of said sphere with respect to its direction of motion for yaw control, and pitch control means including an internal weight and motor means controllable to move said weight to shift the center of gravity of said vehicle, a plurality of stub vortex generators located at the rear of said housing to insure flow attachment into the entrance of said impeller positioned at an angle such that flow across said stub vortex generators acts to counter the torque of said impeller, and a generally cylindrical shroud fastened to the center of said hub, said shroud including a cylindrical member surrounding and spaced from said impeller said shroud having significant weight such that, upon launching of said vehicle, it is caused to make initial contact with said fluid medium and causes said vehicle to sink to a desired depth in said medium after which said power means is energized and said shroud is jettisoned.

5. A self-propelled vehicle as claimed in claim 4 wherein said shroud is threadedly engaged with said hub such that turning of said hub by said power means causes said shroud to separate from said hub.

6. A self-propelled spherical vehicle as claimed in claim 4 wherein the center of gravity of said spherical housing is substantially below the geometrical center of said housing.

* * * * *